US010189544B2

(12) United States Patent
Brizzolara et al.

(10) Patent No.: US 10,189,544 B2
(45) Date of Patent: Jan. 29, 2019

(54) STEPPED CAMBERED PLANING HULL

(71) Applicants: MASSACHUSETTS INSTITUTE OF TECHNOLOGY, Cambridge, MA (US); The United States of America as represented by the Secretary of the Navy, Washington, DC (US); HER MAJESTY THE QUEEN IN RIGHT OF CANADA, Ottawa (CA)

(72) Inventors: Stefano Brizzolara, Blacksburg, VA (US); Calley Dawn Gray, Ottawa (CA); Leon Alexander Faison, Memphis, TN (US); Matthew Joseph Williams, Seattle, WA (US)

(73) Assignees: Massachusetts Institute of Technology, Cambridge, MA (US); Her Majesty the Queen in Right of Canada, Ottawa (CA); United States Department of the Navy, Washington, DC (US)

( * ) Notice: Subject to any disclaimer, the term of this patent is extended or adjusted under 35 U.S.C. 154(b) by 43 days.

(21) Appl. No.: 15/427,826

(22) Filed: Feb. 8, 2017

(65) Prior Publication Data

US 2018/0001963 A1 Jan. 4, 2018

Related U.S. Application Data

(60) Provisional application No. 62/333,333, filed on May 9, 2016, provisional application No. 62/293,380, filed on Feb. 10, 2016.

(51) Int. Cl.
*B63B 1/24* (2006.01)
*B63B 1/22* (2006.01)
(Continued)

(52) U.S. Cl.
CPC ..... *B63B 1/24* (2013.01); *B63B 1/20* (2013.01); *B63B 1/286* (2013.01); *B63B 39/061* (2013.01);
(Continued)

(58) Field of Classification Search
CPC .. B63B 1/00; B63B 1/04; B63B 1/042; B63B 1/16; B63B 1/20; B63B 1/22; B63B 1/24; B63B 1/30; B63B 1/32; B63B 1/38
(Continued)

(56) References Cited

U.S. PATENT DOCUMENTS 3,651,775 A 3/1972 Kock
6,666,160 B1 * 12/2003 Orneblad ..... B63B 1/20 114/288
(Continued)

FOREIGN PATENT DOCUMENTS

WO 2014200407 A1 12/2014

OTHER PUBLICATIONS

Brizzolara, et al., "Designing of V-Stepped Planing Hulls: CFD in Support of Traditional Semi-Empirical Methods" In Proceedings of the Design and Construction of Super and Mega Yachts International Conference, Genoa, Italy, 8 pages, (May 8-9, 2013).
Donald L. Blount and Louis T. Codega, "Dynamic stability of planing boats", Marine Technology and SNAME news, vol. 29(1): pp. 4-12, (1992).
Stefano Brizzolara and Alessandro Federici, "Hydrodynamic analysis of interceptors with CFD methods", Int. Proceedings of the Seventh International Conference on Fast Sea Transportation, vol. 3, pp. 49-56, (2003).
(Continued)

*Primary Examiner* — Lars A Olson
(74) *Attorney, Agent, or Firm* — Nutter McClennen & Fish LLP

(57) ABSTRACT

Various embodiments are disclosed for a stepped cambered planing hull for a boat including a swept back cambered planing surface having a non-linear distribution of camber. The non-linear distribution of camber along the swept back cambered planing surface may enable stepped cambered planing hulls having high deadrise (i.e., greater than 15 degrees). The stepped cambered planing hull may include a
(Continued)

shaped hydrofoil that generates further hydrodynamic lift by piercing the free surface wake produced by the swept back cambered planing surface. The stepped cambered planing hull may have external bottom surfaces adapted at the after-body and transom to accommodate a distinctive profile of the free surface wake produced by the swept back cambered planing surface. The stepped cambered planing hull may include an adjustable interceptor blade to regulate hydrodynamic lift at low speeds or to ensure an optimal dynamic trim angle in a wide range of speeds.

17 Claims, 8 Drawing Sheets

(51) Int. Cl.
*B63B 1/20* (2006.01)
*B63B 1/28* (2006.01)
*B63B 39/06* (2006.01)

(52) U.S. Cl.
CPC ..... *B63B 1/22* (2013.01); *B63B 2001/201* (2013.01); *B63B 2001/202* (2013.01)

(58) Field of Classification Search
USPC ..... 114/280, 282, 288, 291
See application file for complete search history.

(56) References Cited

U.S. PATENT DOCUMENTS

| | | | | |
|---|---|---|---|---|
| 6,925,953 | B1 * | 8/2005 | Batista | B63B 1/38 114/288 |
| 7,870,830 | B2 | 1/2011 | Bogard et al. | |
| 8,820,260 | B2 | 9/2014 | Brizzolara | |
| 2002/0100407 | A1 | 8/2002 | Biddison | |
| 2006/0124042 | A1 | 1/2006 | Schulz | |
| 2008/0210150 | A1 | 9/2008 | Loui et al. | |

OTHER PUBLICATIONS

Stefano Brizzolara, "CFD modeling of planing hulls with partially ventilated bottom", In the William Froude Conference: Advances in Theoretical and Applied Hydrodynamics—Past and Future, 18 pages, (Nov. 24-25, 2010).

Stefano Brizzolara and Francesco Serra, "Accuracy of CFD codes in the prediction of planing surfaces hydrodynamic characteristics", In 2nd International Conference on Marine Research and Transportation, pp. 147-159, (Jun. 2007).

Stefano Brizzolara and Diego Villa, "CFD simulations of planing hulls", In 7th International Conference on High-Performance Marine Vehicles, 9 pages, (Oct. 13-15, 2010).

Eugene P. Clement, "A configuration for a stepped planing boat having minimum drag (dynaplane boat)", retrieved Apr. 11, 2017 from "http://www.foils.org/02_Papers%20dnloads/Clement%20dynaplane.PDF", 76 pages, (2006).

Leon Alexander Faison, "Design of a high speed planing hull with a cambered step and surface piercing hydrofoils", Master's thesis, Massachusetts Institute of Technology, 82 pages, (2014).

Daniel Savitsky, "Hydrodynamic design of planing hulls", Marine Technology, 1(1), pp. 71-95, (1964).

Daniel Savitsky, "Planing craft", Naval Engineers Journal, 97(2), pp. 113-141, (1985).

Daniel Savitsky and P Ward Brown, "Procedures for hydrodynamic evaluation of planing hulls in smooth and rough water", Mahn Technology. 13(4), pp. 381-400, (Oct. 1976).

Kowalyshyn D. H. and Metcalf B. "A USCG Systematic Series of High Speed Planing Hulls", SNAME Transactions, vol. 114, pp. 268-309, (2006).

Stefano Brizzolara, et al., "High Deadrise Stepped Cambered Planing Hulls with Hydrofoils: SCPH2. A Proof of Concept", The Fifth Chesapeake Power Boat Symposium, 10 pages, (Jun. 2016).

International Search Report and the Written Opinion of the International Searching Authority in International Application No. PCT/US17/17121 dated May 30, 2017.

* cited by examiner

STEPPED CAMBERED PLANING HULL

RELATED APPLICATIONS

This application claims the benefit of U.S. Provisional Patent Application No. 62/293,380, filed on Feb. 10, 2016 and U.S. Provisional Patent Application No. 62/333,333, filed on May 9, 2016, the entire contents of which are incorporated herein by reference/

GOVERNMENT RIGHTS

This invention was made with Government support under Grant No. N00014-13-1-0332 awarded by the Office of Naval Research. The Government has certain rights in the invention.

BACKGROUND

A traditional form of a boat hull is a displacement hull, which is characterized by a rounded bilge. Buoyancy, or lift, is generated by the amount of water the hull displaces as it moves through the water. Wave-making resistance, resulting from the formation of a bow wave, is typically the dominant form of drag for displacement hulls. As the speed of the boat increases, the length, height and speed of the generated bow wave increases as well. The wave-making resistance may increase exponentially until the wavelength of the bow wave is equal to the waterline length of the boat. At this point, the boat may be trapped climbing the trough of its own large bow wave, resulting in a virtual barrier to speed increase.

Planing hulls are designed to overcome displacement hull speed by skimming across the surface of the water. At lower speeds, wave-making resistance is still the dominant form of drag. At higher speeds, planing hulls are designed to generate hydrodynamic lift forces proportional to the speed of the boat. The total lift felt by the hull is a combination of the hydrodynamic lift and hydrostatic lift. Hydrodynamic lift is caused by the water passing over the planing surface. Hydrostatic lift is a function of the underwater volume of the hull. At lower speeds, planing hulls are primarily supported by buoyant, hydrostatic forces. As speed increases, hydrodynamic lift is generated and hydrostatic forces acting on the hull gradually decrease. As the boat transitions into a planing regime, the hull rises above its static flotation level and trims up by the bow, thereby reducing the wetted surface significantly. Hydrodynamic lift may continue to increase until the hydrostatic force felt by the hull is negligible, and the boat is fully planing.

SUMMARY

Various embodiments are disclosed herein for an improved stepped cambered planing hull for a boat that may include a swept back cambered planing surface having a non-linear distribution of camber to generate hydrodynamic lift with reduced drag. In some embodiments, the non-linear distribution of camber along the swept back cambered planing surface may enable stepped cambered planing hulls having high deadrise (i.e., greater than 15 degrees). In some embodiments, the stepped cambered planing hull may include a hydrofoil that generates further hydrodynamic lift by piercing the free surface wake produced by the swept back cambered planing surface. In some embodiments, the stepped cambered planing hull may have external bottom surfaces adapted at the after-body and transom to accommodate a distinctive profile of the free surface wake produced by the swept back cambered planing surface, thereby reducing wetting and hull slamming. In some embodiments, the stepped cambered planing hull may include an adjustable interceptor blade to regulate hydrodynamic lift at low speeds or to ensure an optimal dynamic trim angle in a wide range of speeds.

In some embodiments, the planning hull for a boat, may include a fore-body portion, a swept back cambered portion having an external bottom surface with a non-linear distribution of camber, an after-body portion and a step that vertically offsets the after-body portion from the swept back cambered portion towards and interior of the planning hull. The swept back cambered portion may extend from the fore-body portion. In some embodiments, the swept back cambered portion may be a V-shaped swept back cambered portion. In some embodiments, the fore-body portion of the planing hull may have a deadrise angle equal to or greater than fifteen degrees.

In some embodiments, the camber of the external bottom surface may vary transversely across the swept back cambered portion in amplitude, phase, or any combination thereof. In some embodiments, the camber of the external bottom surface may have a flat portion, a rising curved portion and falling curved portion. In some embodiments, the camber of the eternal bottom surface may be a Johnson three term camber.

In some embodiments, the planing hull may include a transom having an external bottom surface of the transom with a W-shaped cross sectional profile. In some embodiments, an external bottom surface of the after-body portion may have a cross section profile, wherein the cross section profile transitions from the W-shaped cross sectional profile of the transom to a V-shaped cross section profile along a longitudinal length of the after-body portion.

In some embodiments, the planing hull may include a hydrofoil attached or adjacent to a transom of the planning hull. In some embodiments, the hydrofoil may be a U-shaped hydrofoil. In some embodiments, the hydrofoil may be a W-shaped hydrofoil.

In some embodiments, the planing hull may further include an interceptor blade positioned at or adjacent to the step that may be automatically lowered to pierce the free water surface at non-planing speeds. In some embodiments, the interceptor blade may be automatically lowered to a depth that exceeds a height of the step to increase a size of the swept back cambered portion. In some embodiments, the interceptor blade may be automatically raised or retracted at planing speeds. In some embodiments, the interceptor blade may conform to and extend for the entire length of a trailing edge of the cambered planing portion. In some embodiments, the interceptor blade may conform to and extend for a truncated length of a trailing edge of the cambered planing portion.

BRIEF DESCRIPTION OF THE DRAWINGS

The accompanying drawings, which are incorporated herein and constitute part of this specification, illustrate exemplary embodiments, and together with the general description given above and the detailed description given below, serve to explain the features of the various embodiments.

DETAILED DESCRIPTION

Various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the claims.

Various embodiments are disclosed herein for an improved stepped cambered planing hull that may include a swept back cambered planing surface having a non-linear distribution of camber configured to generate hydrodynamic lift with reduced drag. In some embodiments, the non-linear distribution of camber along the swept back cambered planing surface may enable stepped cambered planing hulls having high deadrise (i.e., greater than 15 degrees). In some embodiments, the stepped cambered planing hull may include one or more hydrofoils positioned near the stern configured to generate further hydrodynamic lift by piercing the free surface wake produced by the swept back cambered planing surface. In some embodiments, the stepped cambered planing hull may have external bottom surfaces adapted at the after-body and transom to accommodate the profile of the free surface wake produced by the swept back cambered planing surface, thereby reducing wetting and hull slamming when the hull is planing. In some embodiments, the stepped cambered planing hull may include an adjustable interceptor blade on an aft portion of the swept back cambered planing surface that is configured to regulate hydrodynamic lift, particularly at low speeds, and/or to ensure an optimal dynamic trim angle in a wide range of speeds.

Figure 1A:
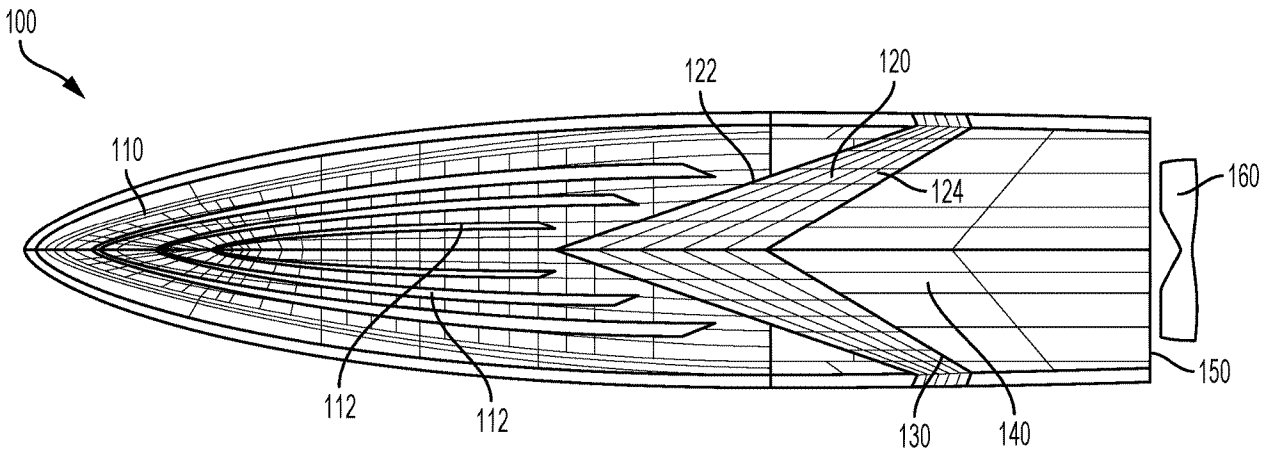
FIGS. 1A and 1B are schematic diagrams illustrating the bottom and side plan views of a stepped cambered planing hull according to some embodiments.
Figure 1B:
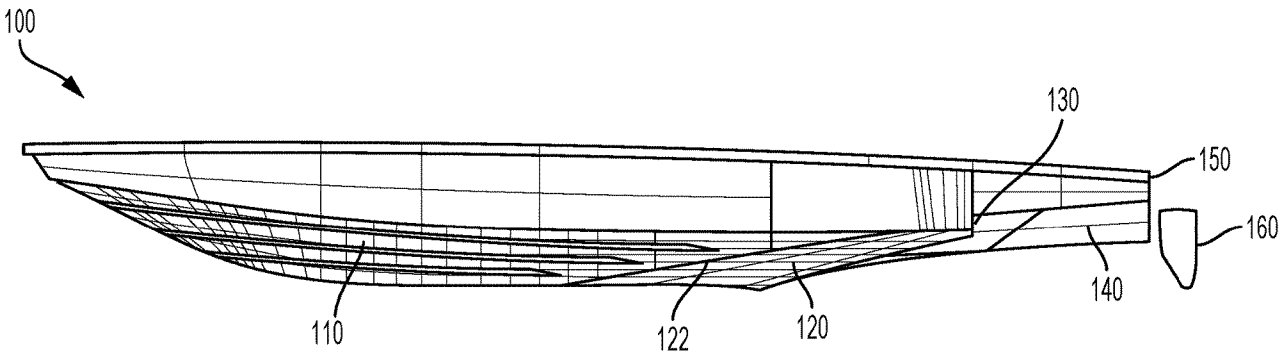

FIGS. 1A and 1B are schematic diagrams illustrating the bottom and side plan views of a stepped cambered planing hull 100 according to some embodiments. As shown, the planing hull 100 may include a fore-body portion 110, a swept back cambered portion 120, a step 130, an after-body portion 140, a transom 150, and a hydrofoil 160. In some embodiments, the planing hull may also include an interceptor (not shown).

The fore-body portion 110 may form the bow or a portion thereof. In some embodiments, the fore-body portion 110 may form a V-shaped bow or portion thereof having a high deadrise (e.g., 15 degrees or more). The fore-body portion 110 may extend from the tip of the bow to a leading edge 122 of the swept back cambered portion 120. In some embodiments, the fore-body portion 110 may include spray rails 112 arranged on an external bottom surface, such that at least one end of each spray rail is angled towards the swept back cambered portion 120 to force water flow towards that region.

In some embodiments, the swept back cambered portion 120 may be bounded in a longitudinal direction between a leading edge 122 and a trailing edge 124 and in a transverse direction by the sides of the hull. In some embodiments, the swept back cambered portion 120 may be V-shaped as shown in FIG. 1A. As the speed of the boat increases, the swept back cambered portion 120 may become a wetted planing surface that provides the majority of the hydrodynamic lift for the hull 100. In some embodiments, the swept back cambered portion 120 may have an external bottom surface with a non-linear distribution of camber to provide the hydrodynamic lift with reduced drag. Embodiments of the external bottom surface of the swept back cambered portion 120 are disclosed with reference to FIGS. 2 and 3A-3C.

In some embodiments, the step 130 may be positioned between the cambered portion 120 and the after-body portion 140 to vertically offset the after-body portion 140 towards an interior of the hull. In some embodiments, a first end of the step 130 may be joined to the trailing edge 124 of the swept back cambered portion and a second end of the step 130 may be joined to a leading edge of the after-body portion 140. Embodiments of the step 130 are disclosed with reference to FIG. 4.

In some embodiments, the after-body portion 140 may extend aft of the step 130 towards the transom 150. In some embodiments, the after-body portion 140 and the transom 150 may have an external bottom surface adapted to accommodate the profile of the free surface wave that is produced by the swept back cambered portion 120 when the hull is planing. The profile of the free surface wave may be distinctive of the swept back cambered portion 120 shape. Embodiments of the external bottom surface of the after-body portion 140 and the transom 150 are disclosed with reference to FIGS. 5A and 5B.

In some embodiments, a hydrofoil 160 may be attached to or positioned at or near the transom 150 to provide additional hydrodynamic lift on the afterbody. In some embodiments, the hydrofoil 160 may be actuated by a servomechanism, and controlled to provide trim control and stability. Embodiments of the hydrofoil 160 are disclosed with reference to FIG. 6.

Figure 2:
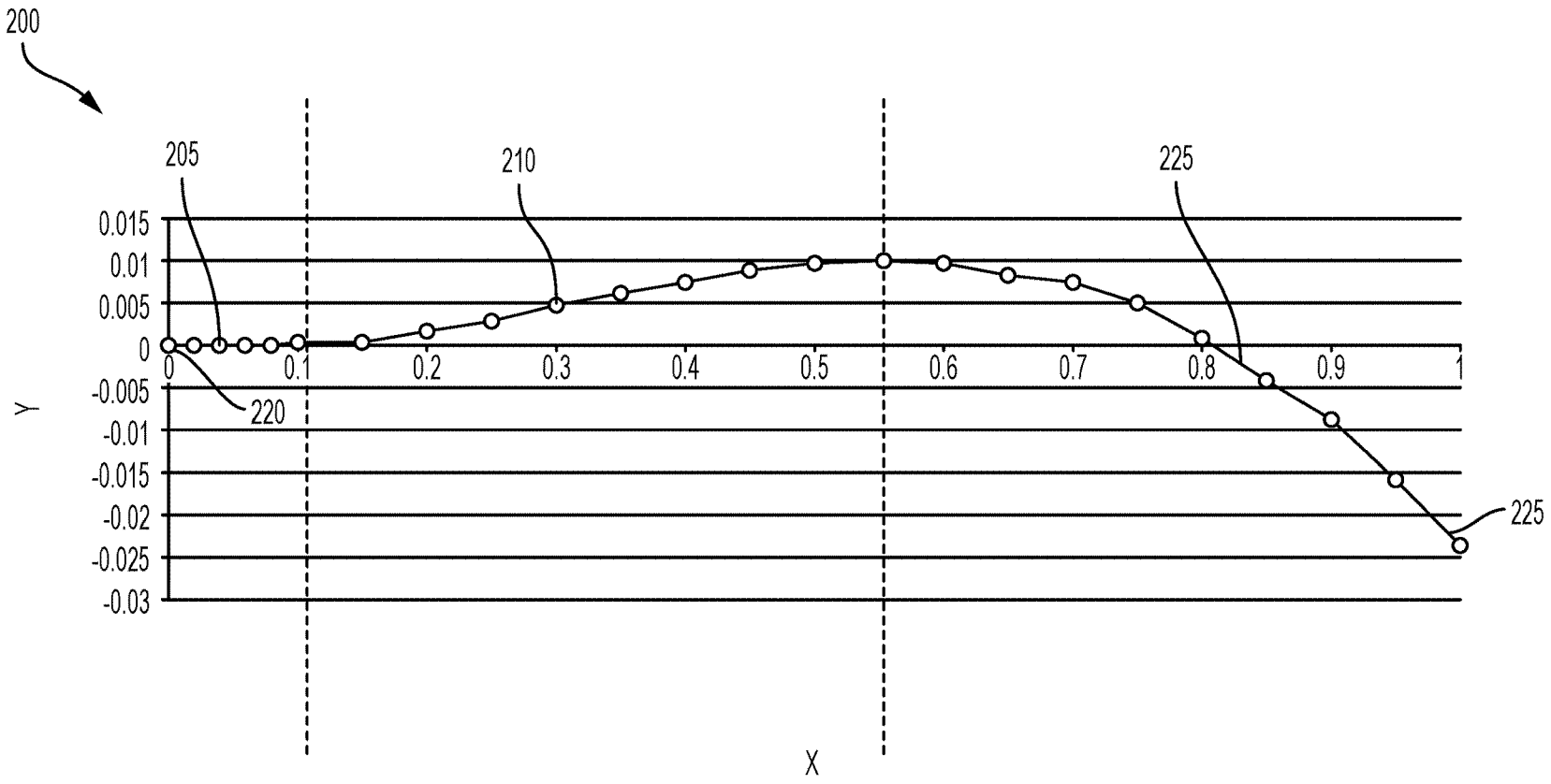
FIG. 2 is a schematic diagram that illustrates a section profile that may be used to form a cambered planing surface according to some embodiments.

The swept back cambered portion 120 may have an external bottom surface with a non-linear distribution of camber. FIG. 2 is a schematic diagram that illustrates a planform shape 200 that may be used to form a cambered planing surface according to some embodiments. In some embodiments, the planform shape 200 may be similar to a Johnson Three Term Camber. In some embodiments, the planform shape 200 may have a relatively flat portion 205, a curved falling portion 210 and a curved rising portion 215, resulting in a generally a convex curvature. In some embodiments, the planform shape 200 may be scaled to fit between the leading and trailing edges of the cambered portion 122, 124. For example, the first end 220 of the planform shape 200 may correspond to a point on the leading edge 122 of the cambered portion adjacent to the fore-body 110, and the second end 225 may correspond to a point on the trailing edge 124 of the cambered portion adjacent to the step 130. In some embodiments, the amplitude, phase, or both the amplitude and phase of the section profile 200 may be varied transversely across the swept back cambered portion 120 to form an external bottom surface having a non-linear distribution of camber. A swept back cambered portion 120 having a non-linear distribution of camber may produce more hydrodynamic lift with reduced drag compared to a planing surface having a linear distribution of camber (i.e., where the camber is scaled to fit with the cambered portion 120 but is not varied in terms of amplitude or phase).

Figure 3A:
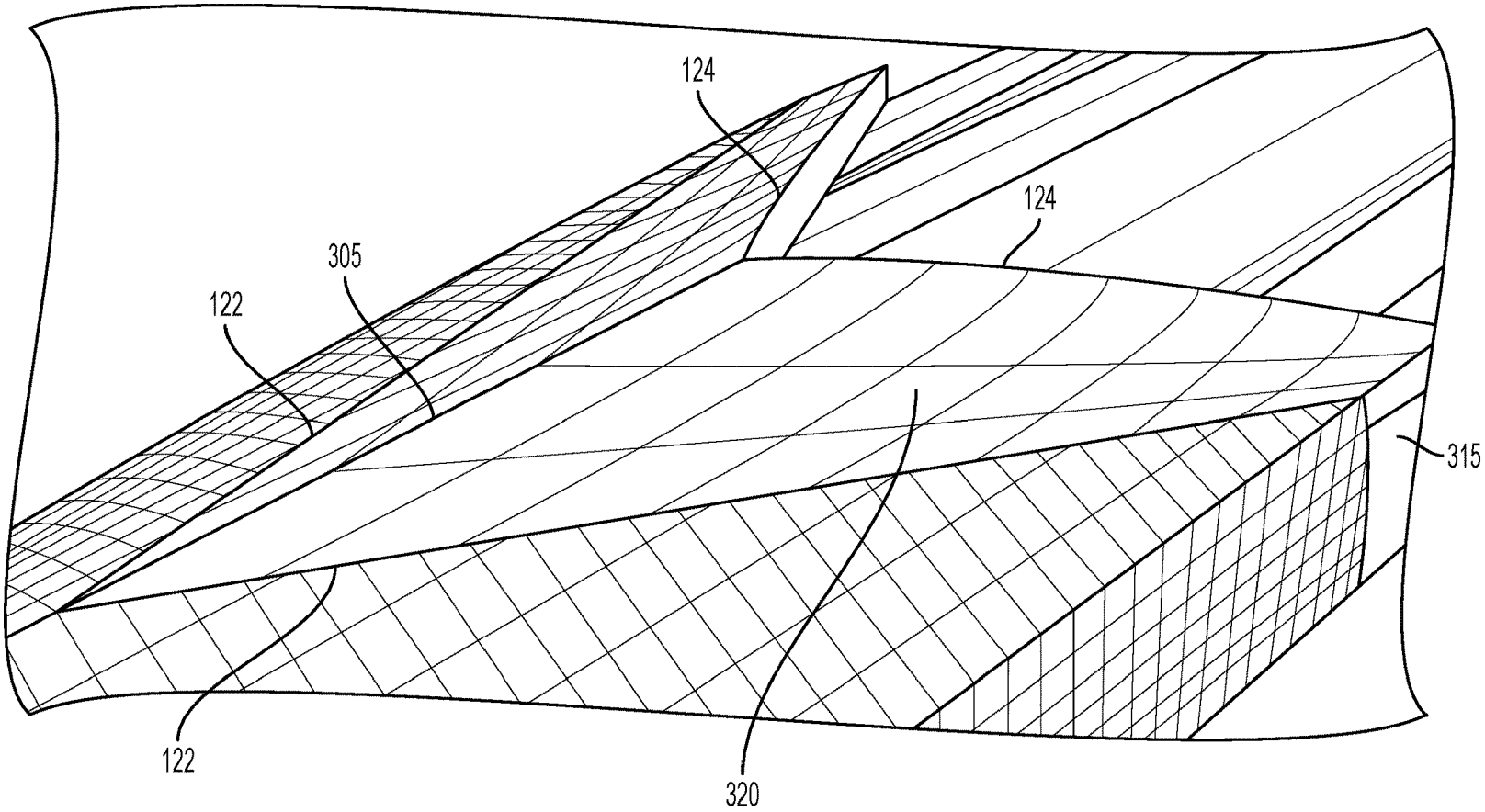
FIGS. 3A and 3B are schematic diagrams that illustrate perspective and front views of a swept back cambered portion having a non-linear distribution of camber according to some embodiments.
Figure 3B:
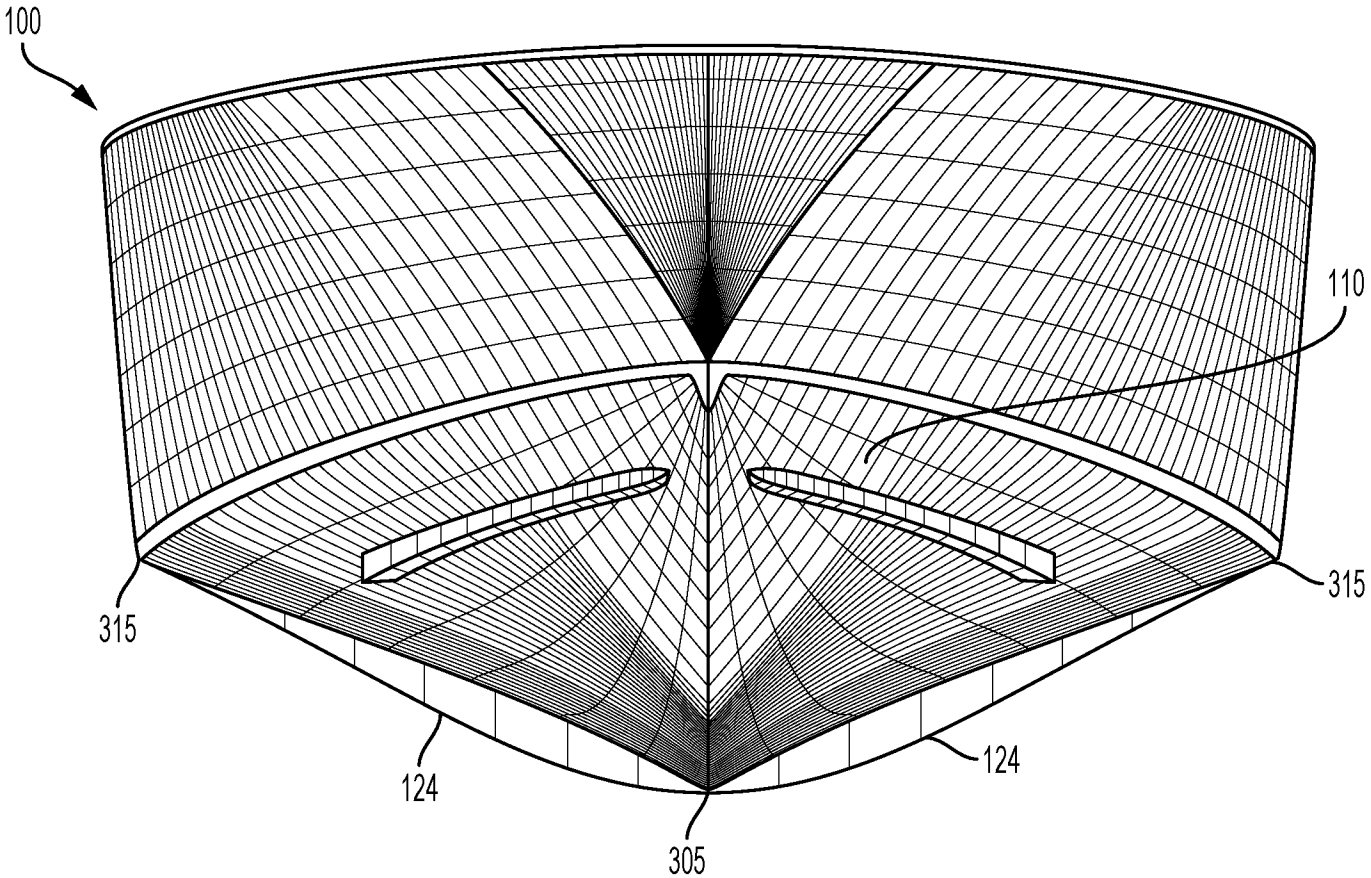

FIGS. 3A and 3B are schematic diagrams that illustrate perspective and front views of a swept back cambered portion 120 having a non-linear distribution of camber according to some embodiments. For example, referring to FIG. 3A, in some embodiments, there may be less camber (e.g., curvature) along the keel 305 and the chine 315 and more camber between the keel 305 and the chine 315 (e.g., a recessed surface area 320). In some embodiments, the trailing edge 124 of the cambered portion may also exhibit non-linearity. For example, as shown in FIG. 3B, the trailing edge 124 of the cambered portion may have a height that varies non-linearly between the keel 305 and the chine 315 on each side of the hull 100 (e.g., in an outwardly extending curve).

Figure 4:
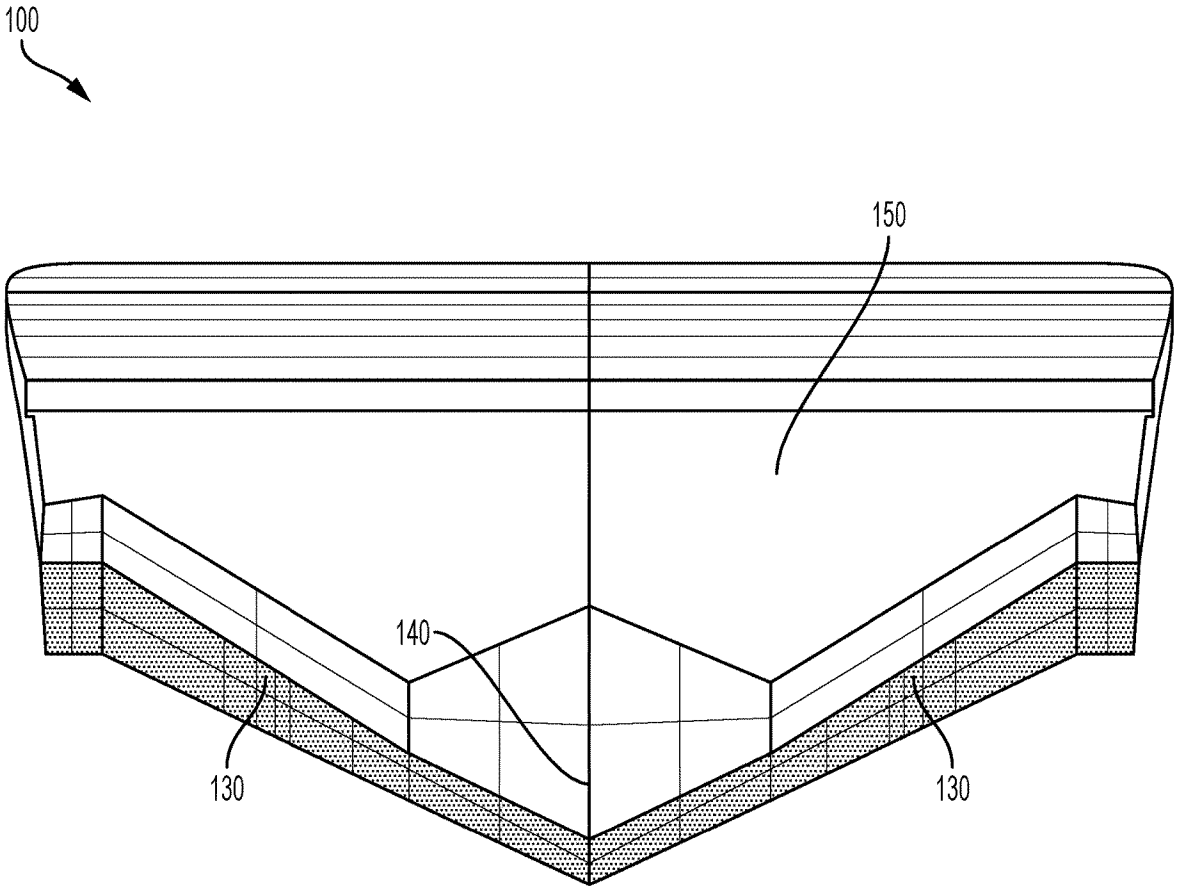
FIG. 4 is a schematic diagram that illustrates a step 130 of the planing hull according to some embodiments.

FIG. 4 is a schematic diagram that illustrates a step 130 of the planing hull 100 according to some embodiments. As previously discussed, the step 130 may provide a vertical offset between the swept back cambered portion 120 and the after-body portion 140. While planing, the step 130 forces the separation of water flow from the swept back cambered portion 120 over the after-body portion 140 of the hull and facilitates ventilation of the after-body portion 140. With a significant portion of the after-body portion 140 remaining dry due to the stepped ventilation, there may be a considerable reduction in wetting surface area of the hull 100 during planing, and thus reduced drag due to water resistance at speeds sufficient for planing (e.g., 55 knots or greater).

In some embodiments, the step 130 may extend transversely across the entire length of the bottom surface of the planing hull 100. In some embodiments, the step 130 may have a shape that conforms to the shape of the trailing edge 124 of the swept back cambered portion 120. For example, in some embodiments, the step 130 may be a V-shaped step that conforms to a V-shaped trailing edge 124 of the swept back cambered portion 120.

In some embodiments, the height of the step 130 may be configured to allow full ventilation of the after-body portion 140 of the hull at higher speeds. In some embodiments, the step height may include an additional allowance to account for the effect of a change in the dynamic trim and sinkage of the hull at lower speeds, and/or pitching of the hull at lower sea states. For example, as shown in FIG. 4, the step height may have a value that equals four percent (4%) of the chine beam for the middle third of the hull and then gradually increases to a maximum value of eight percent (8%) of the chine beam at the flat of the chine.

Figure 5A:
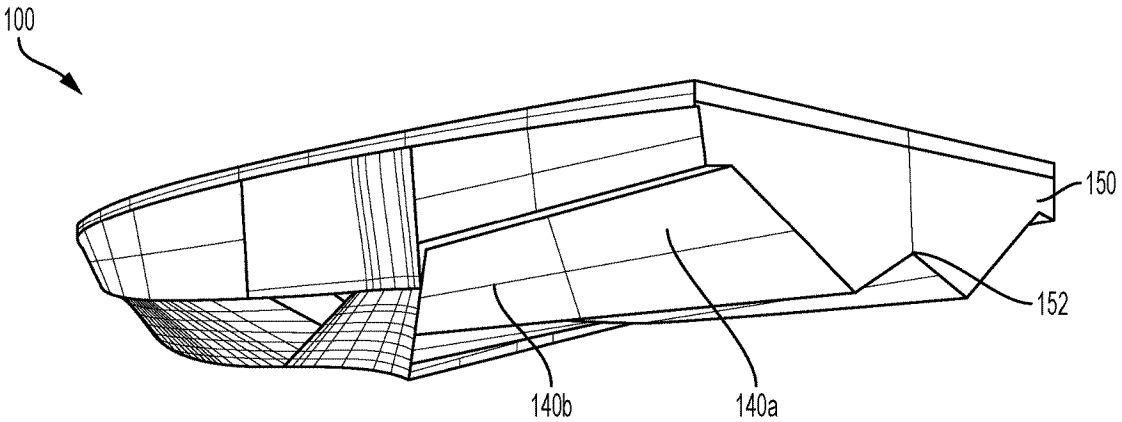
FIGS. 5A and 5B are schematic diagrams that illustrate perspective and plan views of external bottom surfaces of the after-body portion and the transom 150 according to some embodiments.
Figure 5B:
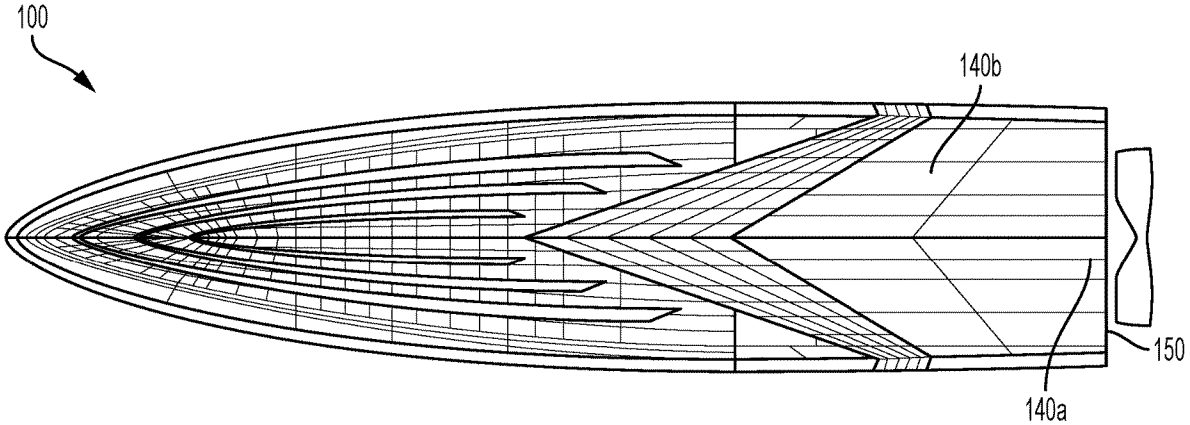

FIGS. 5A and 5B are schematic diagrams that illustrate perspective and plan views of external bottom surfaces of the after-body portion 140 and the transom 150 according to some embodiments. As previously discussed, the step 130 forces the separation of water flow from the swept back cambered portion 120 while planing. In some embodiments, the water flow from the swept back cambered portion 120 may produce a wake during planning that exhibits a peak along a longitudinal centerline of the hull under the after-body portion 140 and the transform 150. Thus, in order to avoid hull slamming and wetting during planning, the external bottom surfaces of the after-body portion 140 and the transform 150 may be adapted to accommodate the shape of the wake profile that is a characteristic of the swept back cambered portion 120.

For example, in some embodiments, the transom 150 may be formed with a W-shaped profile 152 that extends along the external bottom surface of the transom and into a first external bottom surface 140*a* of the after-body portion 140. The W-shaped profile 152 of the first external bottom surface 140*a* may then gradually transition into a V-shaped profile of a second external bottom surface 140*b*.

Figure 6:
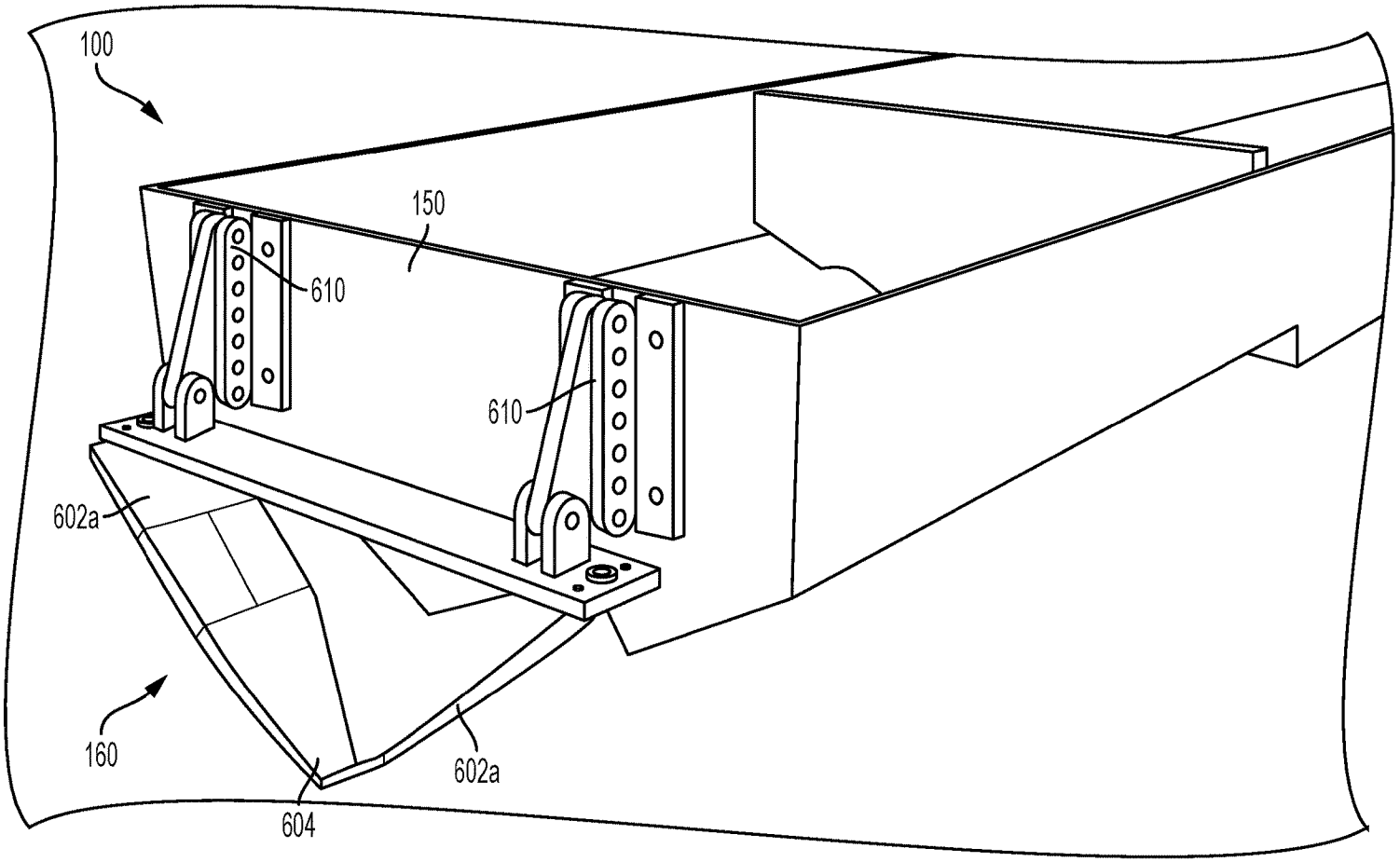
FIG. 6 is a schematic diagram that illustrates a perspective view of a surface piercing hydrofoil that may be attached or positioned adjacent to the transom according to some embodiments.

FIG. 6 is a schematic diagram that illustrates a perspective view of a surface piercing hydrofoil 160 that may be attached or positioned on or adjacent to the transom 150 according to some embodiments. For example, the hydrofoil 160 may be attached or positioned on or adjacent to the transom 150 by an attachment device 610. In some embodiments, the attachment device 610 may be operated to raise or lower the hydrofoil 160 in order to pierce a free water surface at a desired depth. As the speed of the boat is increased, the hydrofoil 160 provides additional hydrodynamic lift to raise the after-body portion 140 and transom 150 out of the water, thereby decreasing the wetted surface area and drag. The hydrofoil 160 on or adjacent to the transom may also provide added trim stability.

In some embodiments, the hydrofoil 160 may be a seamless V-shaped hydrofoil having two opposing hydrofoil elements 602*a*, 602*b* connected to a vertex 604 having a flattened central portion. An embodiment of a seamless V-shaped hydrofoil is disclosed in U.S. Pat. No. 8,820,260, the entire contents of which are incorporated herein by reference for details related to V-shaped hydrofoils.

In some embodiments, the hydrofoil 160 may be a seamless U-shaped hydrofoil having two opposing hydrofoil elements that connect at a curved central portion. In some embodiments, the hydrofoil 160 may also be a seamless W-shaped hydrofoil that includes multiple hydrofoil elements (e.g., two inner hydrofoil elements and two outer hydrofoil elements) interconnected to form a W-shaped cross section. In some embodiments (not shown), the hydrofoil 160 may include two separate (i.e., not seamless) surface piercing, super cavitating hydrofoils that may extend outwardly from the opposite sides of the after-body portion 140 adjacent to the transom 150. In some embodiments (not shown), the hydrofoil 160 may include two separate (i.e., not seamless) surface piercing, super cavitating hydrofoils that extend inwardly from the opposite sides of the after-body portion 140 adjacent to the transom 150.

Figure 7A:
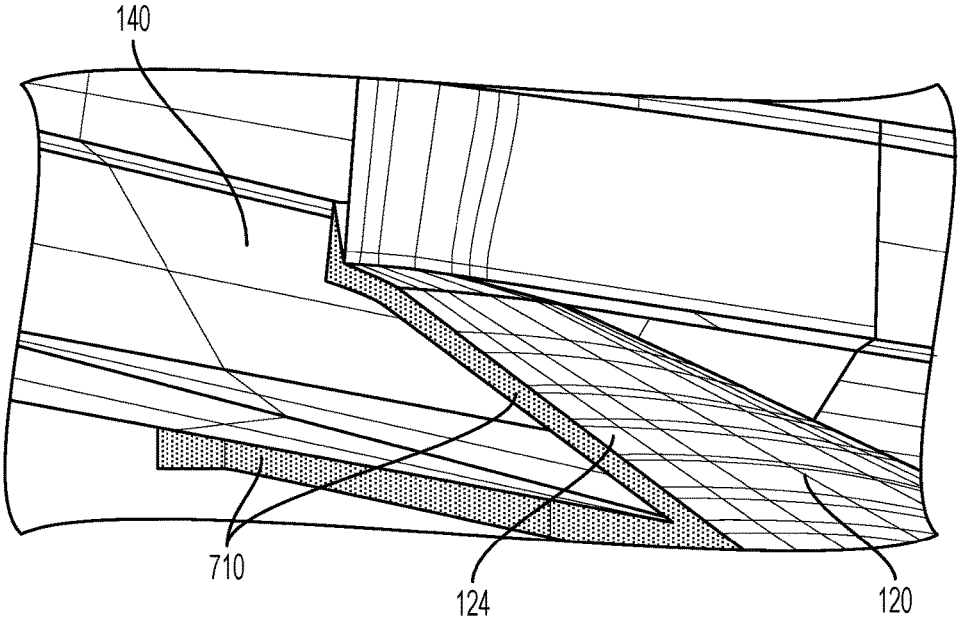
FIGS. 7A and 7B are schematic diagrams that illustrate a stepped cambered planing hull that includes an adjustable interceptor blade according to some embodiments.
Figure 7B:
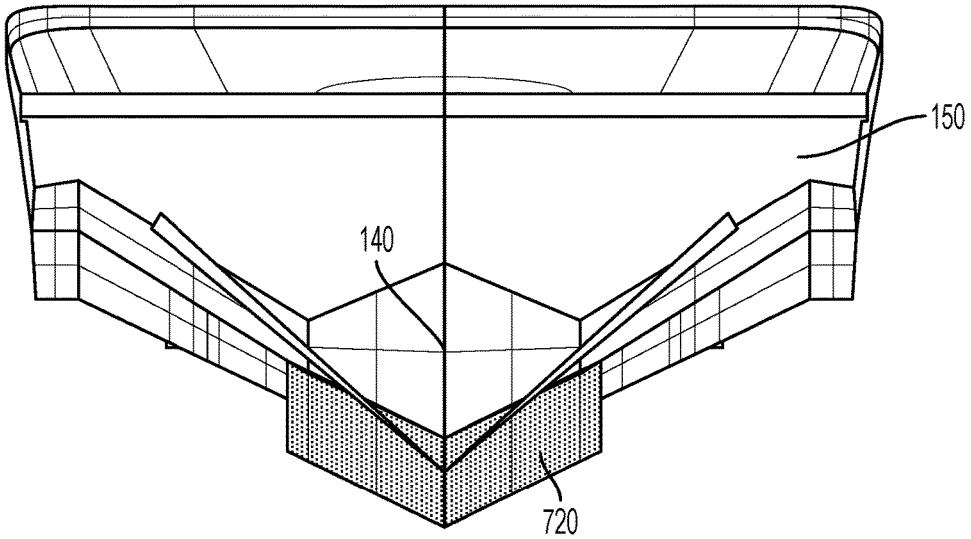

FIGS. 7A and 7B are schematic diagrams that illustrate a stepped cambered planing hull 100 that includes an adjustable interceptor blade 710 or 720 positioned on an aft portion of the swept back cambered portion 120 according to some embodiments. In order to increase lift of the swept back cambered portion 120, an adjustable interceptor blade 710 or 720 may be lowered from a housing within an interior portion of the hull through a gap at or adjacent to the step 130 or adjacent to the step 130 in the after-body portion 140. The interceptor blade 710 or 720 effectively increases lift generated by the surface of the cambered planing portion 120, with the amount of lift depending on the extent that the interceptor blade 710 pierces the free water surface. As water flows over the interceptor blade 710 or 720, additional hydrodynamic lifting force is generated normal to the surface of the hull at the blade. This additional hydrodynamic lift may help to raise the after-body portion 140 out of the water, thereby facilitating ventilation of the after-body portion and reducing drag at low planing speeds. The adjustable interceptor blade 710 or 720 may enable planning at lower speeds as well as compensating for increased weight in the hull (e.g., from cargo or crew) at normal planing speeds. In some embodiments, the interceptor blade 710 or 720 may be lowered to a depth that exceeds the height of the step 130. When the speed increases such that the swept back cambered portion 120 provides all the lifted need to achieve low-drag planing, the interceptor blade 710 or 720 may be retracted back into the housing.

In some embodiments, as shown in FIG. 7A for example, the adjustable interceptor blade 710 may be a flat plate having a beveled end that conforms to and extends for the entire length the trailing edge 124 of the cambered planing portion 120. In some embodiments, as shown in FIG. 7B for example, the adjustable interceptor blade 710 may be a flat plate having a beveled end that conforms to and extends for a truncated length the trailing edge 124 of the cambered planing portion 120. In some embodiments, the adjustable interceptor blade 710 or 720 may automatically be raised or lowered using a device (not shown) that actuates based on the measured boat speed. For example, in some embodiments, the device may automatically lower the adjustable interceptor blade 710 or 720 in response to the device determining that the speed is below a low speed threshold (e.g., a speed at which the hull will not plane based solely on the swept back cambered portion 120). Similarly, the device may automatically raise or retract the adjustable interceptor blade 710 or 720 into the housing in response to the device determining that the speed exceeds the low speed threshold for planing based solely on the swept back cambered portion 120. In some embodiments, the device may use threaded rods with two knurled threaded discs atop to accurately move the rod up or down and help prevent any play in the interceptor plate. Oversized slots may be drilled near the bottom of the plate so that machine screws can be used to secure the plate to the aft surface of the step. As an example, the interceptor blade 710 or 720 itself may be a 3/16" stainless steel plate.

The preceding description of the disclosed embodiments is provided to enable any person skilled in the art to make or use the claims. Various modifications to these embodiments will be readily apparent to those skilled in the art, and the generic principles defined herein may be applied to other embodiments without departing from the scope of the claims. Thus, the present disclosure is not intended to be limited to the embodiments shown herein but is to be accorded the widest scope consistent with the following claims and the principles and novel features disclosed herein.

What is claimed is:

1. A planing hull for a boat, comprising:

a fore-body portion;

a V-shaped swept back cambered portion, wherein the swept back cambered portion extends from the fore-body portion and is longitudinally bounded between a V-shaped leading edge and a V-shaped trailing edge;

a step; and an after-body portion, wherein the step vertically offsets the after-body portion from the swept back cambered portion towards an interior of the planing hull, and wherein an external bottom surface of the V-shaped swept back cambered portion has a non-linear distribution of camber, such that the camber of the V-shaped swept back cambered portion is greater between a keel and chine on a respective side of the hull than along the keel and the chine.

2. The planing hull of claim 1, wherein the camber of the external bottom surface varies transversely across the swept back cambered portion in amplitude, phase, or a combination of amplitude and phase.

3. The planing hull of claim 1, wherein the camber of the external bottom surface has a flat portion, a rising curved portion and falling curved portion.

4. The planing hull of claim 1, wherein the camber of the eternal bottom surface is a Johnson three term camber.

5. The planing hull of claim 1, wherein the fore-body portion has a deadrise angle equal to or greater than fifteen degrees.

6. The planing hull of claim 1, further comprising a transom, wherein an external bottom surface of the transom has a W-shaped cross sectional profile.

7. The planing hull of claim 6, wherein an external bottom surface of the after-body portion has a cross section profile, wherein the cross section profile transitions from the W-shaped cross sectional profile to a V-shaped cross section profile along a longitudinal length of the after-body portion.

8. The planing hull of claim 1, further comprising a U-shaped hydrofoil attached or position adjacent to a transom of the planing hull.

9. The planing hull of claim 1, further comprising a W-shaped hydrofoil attached or positioned adjacent to a transom of the planing hull.

10. The planing hull of claim 1, further comprising:

an interceptor blade positioned at or adjacent to the step, wherein the interceptor blade is configured to be lowered to pierce a free water surface to increase lift.

11. The planing hull of claim 10 wherein the interceptor blade is configured to be lowered to a depth that exceeds a height of the step to increase a size of the swept back cambered portion.

12. The planing hull of claim 1, wherein the interceptor blade is configured to be raised or retracted at planing speeds.

13. The planing hull of claim 1, wherein the interceptor blade conforms to and extends for the entire length of the V-shaped trailing edge of the swept back cambered portion.

14. The planing hull of claim 1, wherein the interceptor blade conforms to and extends for a truncated length of the V-shaped trailing edge of the swept back cambered portion.

15. The planing hull of claim 1, wherein a height of the V-shaped trailing edge of the swept back cambered portion varies nonlinearly between the keel and the chine.

16. A planing hull for a boat, comprising:

a fore-body portion;

a swept back cambered portion, wherein the swept back cambered portion extends from the fore-body portion;

a step; and an after-body portion, and a transom;

wherein the step vertically offsets the after-body portion from the swept back cambered portion towards an interior of the planing hull, and wherein an external bottom surface of the swept back cambered portion has a non-linear distribution of camber; and wherein an external bottom surface of the transom has a W-shaped cross sectional profile.

17. The planing hull of claim 16, wherein an external bottom surface of the after-body portion has a cross section profile, wherein the cross section profile transitions from the W-shaped cross sectional profile to a V-shaped cross section profile along a longitudinal length of the after-body portion.

* * * * *